US012134858B2

(12) United States Patent
Fabry et al.

(10) Patent No.: US 12,134,858 B2
(45) Date of Patent: Nov. 5, 2024

(54) SHEATH FOR A STRUCTURAL CABLE

(71) Applicant: SOLETANCHE FREYSSINET, Rueil Malmaison (FR)

(72) Inventors: Nicolas Fabry, Antony (FR); Emmanuel Cros, Paris (FR); Julien Erdogan, Colombes (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 696 days.

(21) Appl. No.: 17/420,916

(22) PCT Filed: Jan. 7, 2019

(86) PCT No.: PCT/IB2019/000098
§ 371 (c)(1),
(2) Date: Jul. 6, 2021

(87) PCT Pub. No.: WO2020/144489
PCT Pub. Date: Jul. 16, 2020

(65) Prior Publication Data

US 2022/0064855 A1 Mar. 3, 2022

(51) Int. Cl.

| | |
|---|---|
| ***E01D 19/16*** | (2006.01) |
| ***D07B 1/16*** | (2006.01) |
| ***D07B 5/00*** | (2006.01) |
| ***E04H 12/20*** | (2006.01) |

(52) U.S. Cl.
CPC ..... *D07B 5/006* (2015.07); *D07B 1/162* (2013.01); *E01D 19/16* (2013.01); *E04H 12/20* (2013.01); *D07B 2201/2086* (2013.01); *D07B 2401/203* (2013.01); *D07B 2501/203* (2013.01)

(58) Field of Classification Search
CPC D07B 5/006; D07B 1/162; D07B 2201/2086; D07B 2401/203; D07B 2501/203; E01D 19/16; E04H 12/20
USPC ..... 14/18–22
See application file for complete search history.

(56) References Cited

U.S. PATENT DOCUMENTS

| | | | | |
|---|---|---|---|---|
| 4,569,708 | A | 2/1986 | Tanaka et al. | |
| 6,386,526 | B1 * | 5/2002 | Sarkar | F16F 15/00 267/140.3 |
| 6,705,440 | B2 * | 3/2004 | Phelan | F16F 7/1005 267/136 |
| 7,950,093 | B2 * | 5/2011 | Brand | E04C 5/10 14/22 |

(Continued)

FOREIGN PATENT DOCUMENTS

| | | |
|---|---|---|
| CN | 105926442 | 9/2016 |
| JP | H08-068011 | 3/1996 |

(Continued)

OTHER PUBLICATIONS

International Search Report and Written Opinion of PCT/IB2019/000098, Aug. 28, 2019, 13 pages.

*Primary Examiner* — Raymond W Addie
(74) *Attorney, Agent, or Firm* — HSML P. C.

(57) ABSTRACT

The sheath (20) for a structural cable (10) has an outer surface to be exposed to an environment of a construction work equipped with the structural cable (10). The outer surface of the sheath has a roughness texture (30) to promote retention of frozen water. In at least an upper part of the length of the sheath (20), the roughness texture (30) covers more than half of the outer surface of the sheath.

11 Claims, 4 Drawing Sheets

(56) References Cited

U.S. PATENT DOCUMENTS

| | | | | |
|---|---|---|---|---|
| 2015/0152611 | A1* | 6/2015 | Georgakis | D07B 5/005<br>14/22 |
| 2021/0062530 | A1* | 3/2021 | Annan | E01D 19/16 |

FOREIGN PATENT DOCUMENTS

| | | |
|---|---|---|
| JP | 2006-322177 | 11/2006 |
| JP | 2014-211082 | 11/2014 |
| WO | 2007/078248 | 7/2007 |
| WO | 2014/001514 | 1/2014 |
| WO | 2014/001515 | 1/2014 |
| WO | 2018/196966 | 11/2018 |
| WO | 2019/064042 | 4/2019 |

* cited by examiner

SHEATH FOR A STRUCTURAL CABLE

The present invention relates to a sheath for a structural cable of a construction work, designed in consideration of climate conditions to which the work is exposed.

Typically, it applies to stay cables used to suspend structures such as roofs or bridge decks, or to stabilize structures such as towers or masts.

BACKGROUND

The weather conditions to which cable-stayed constructions are subjected must be taken into consideration in the design of the stay cables.

In particular, rain/wind-induced vibrations are a known problem which is generally considered in the design of the sheaths or ducts that contain the load-bearing armatures of stay cables. The formation of a water rivulet along the cable under moderate rain conditions and its interaction with wind flow have been established as the cause of rain/wind-induced vibrations through studies and wind tunnel tests. See "Wind-Induced Vibration of Stay Cables", Publication No. FHWA-HRT-05-083, US Department of Transportation, Federal Highway Administration, August 2007. Exterior cable surface modifications that interfere with water rivulet formation are a known way of mitigating rain/wind-induced vibrations. Such modifications include helical ridges formed on the outer surface of the cable ducts. Another kind of modification is in the form of dimple patterns on the outer surface of the duct. These types surface modification have been applied on many cable-stayed bridges both with and without other mitigation measures such as external dampers and cable ties.

WO 2014/001514 A1 discloses modifying the outer surface of a stay cable sheath with ridges arranged in an helical pattern and having a specific profile. The helical pattern may be made of ridge segments extending perpendicular to the sheath direction and having axial intervals and circumferential offsets between them. Such ridge formations are expected to reduce or prevent formation of water rivulets on the cable and thus avoid rain/wind-induced vibrations.

Another concern in the design of cable-stayed constructions relates to the ice, frost or snow that may accumulate on the cables in cold weather. There is a risk that ice chunks detached from the cables fall and cause injury to people or damage to equipment (vehicles, devices, roofing, components of the construction work, etc.) under the cables.

Active measures have been proposed to deal with that risk. For example, CN 105926442 A and JP 2006-322177 A propose composite sheaths having an electrical heating layer between two plastic layers. The heating layer is powered to melt the ice or snow accumulated on the outer surface of the sheath. When the heating is activated, the ice melts first at the surface of the sheath. If a relatively thick ice layer has accumulated, large ice chunks or caps can be separated in the process and may cause trouble when falling. So it is generally needed to take special protective measures, such as blocking traffic on a cable-stayed bridge or installing protective shields, when performing the de-icing process.

Other known ways of actively de-icing a stay cable sheath include:

- arranging a chain-link collar around the sheath and dropping or pulling the collar along the sheath to scrape the accumulated ice. This technique is complex to carry out, and efficiency is not assured. It may be inapplicable if there are elements connected to the stays in their running part;

- generating electromagnetic waves from solenoids to peel ice layers off the cable sheath. This is costly and does not prevent the fall of potentially large ice chunks.

WO 2018/196966 A1 combines a conventional composite sheath, having active heating elements, with an helical ridge pattern as disclosed in WO 2014/001514 A1. The ridges on the sheath are expected to retain the ice, so as to limit the risk of ice falling in periods when the heating elements are not activated. The improved retention of ice and snow by the ridge pattern allows targeted lane closures on the cable-stayed bridge for the active de-icing, thus reducing the impact on traffic flow once a significant accumulation of ice is observed on the stays. The document notes that the ridge pattern causes weaknesses in the ice layer when the active system is powered, so that the ice falls as smaller fragments. However, these fragments are still fairly large (several tens of cm) and thick. The fragments are typically not smaller than the pitch of the helical ridge pattern and the diameter of the sheath. They fall quickly once the surface of the sheath starts heating upon turning on the active system, because the weaknesses of the ice layer are localized at the ridges and promote indentation of fairly large pieces before a substantial thickness of ice has molten. Such fragments may still cause damage or injury when falling. This is why special protective measures such as traffic closures are required.

An object of the present invention is to provide another solution to deal with ice or snow accumulations on the sheaths of structural cables while reducing at least some of the above-noted problems.

SUMMARY

The present document discloses a sheath for a structural cable of a construction work, whose outer surface is to be exposed to an environment of the construction work. It is proposed to provide the outer surface of the sheath with a roughness texture to promote retention of frozen water. In at least an upper part of the length of the sheath, the roughness texture covers more than half of the outer surface of the sheath.

The protection thus afforded against ice chunks falling from the structural cable is a passive one. No active elements such as heating resistors are required in the sheath. Ice or snow accumulated on the sheath is retained by the rough surface condition, which increases adherence with frozen water crystals. When the temperature rises over 0° C., the accumulated ice or snow melts starting from its outermost surface, until the layer becomes thin enough to lose its cohesion. At that time, ice fragments may fall from the structural cable. However, such fragments are small due to the roughness of the sheath surface, which divides the thinned ice layer into small bits when the layer is detached from the roughened surface.

Embodiments of the above-defined sheath further include one or more of the following features:

- the roughness texture is arranged such that the outer surface of the sheath has no smooth region in the upper part of the length of the sheath;
- perpendicular to the outer surface of the sheath, the roughness texture comprises elements having dimensions in a range of 0.1 mm to 2 mm;
- parallel to the outer surface of the sheath, the roughness texture comprises elements having dimensions in a range of 0.1 mm to 5 mm;
- protrusions are formed in at least one helical pattern along the sheath, the roughness texture being located between the protrusions;

such protrusions may be formed by at least two helical ribs extending along respective helical paths in opposite directions along the outer surface of the sheath;

the roughness texture is in the form of striations which may extend perpendicular to the direction of the sheath, helically around and along the sheath, or parallel to the sheath.

The sheath may be formed of one piece of (usually plastic) material with a roughness texture on its outer surface as mentioned above.

It may also be formed of a plurality of shells assembled together to close the cross-section of the sheath.

In many cases, the sheath will be formed by assembling two or more sheath segments along the direction of the cable. For such cases, another aspect of the present disclosure relates to a sheath segment for forming a sheath for a structural cable of a construction work when assembled with at least one other segment, the sheath segment having an outer surface to be exposed to an environment of the construction work and provided with a roughness texture to promote retention of frozen water, wherein the roughness texture covers more than half of the outer surface of the sheath segment.

All the segments of the sheath of a given structural cable may be thus fitted with a roughness texture. Alternatively, only the segment(s) having the highest location(s) can have such roughness texture considering that, in the lower part of the cable, falling ice is less dangerous. However, for aesthetic reasons, it may be preferred to have the same kind of sheath segment all along the cable.

BRIEF DESCRIPTION THE DRAWINGS

Other features and advantages of the structural cable sheath disclosed herein will become apparent from the following description of non-limiting embodiments, with reference to the appended drawings, in which.

DESCRIPTION OF EMBODIMENTS

Figure 1:
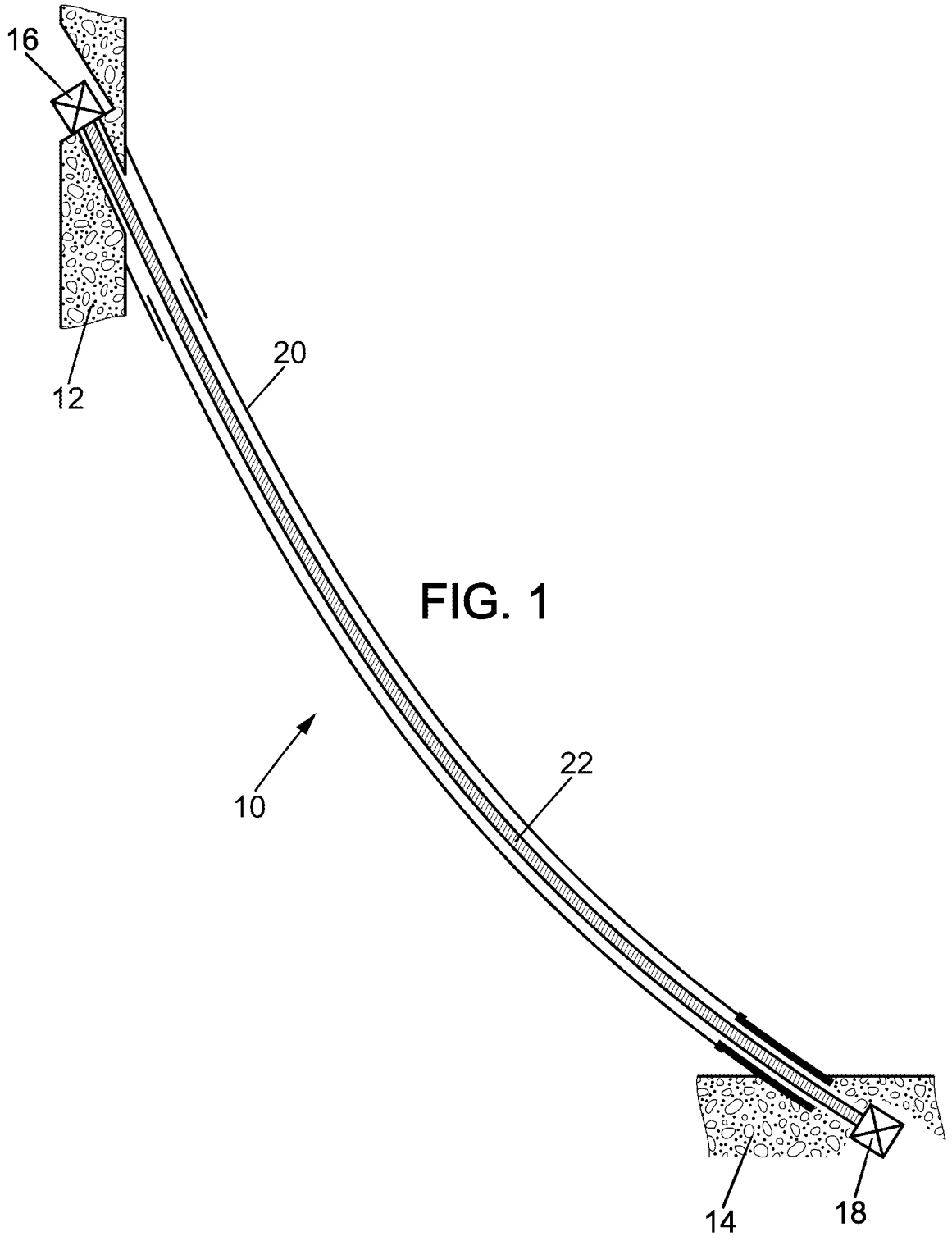
FIG. 1 is a schematic side view of a stay cable.

FIG. 1 shows a structural cable 10 that may be equipped with a sheath 20 according to the invention.

The cable 10 is, for example, a stay extending along an oblique path between first and second parts 12, 14 where it is anchored using respective anchoring devices 16, 18. The stay cable is used to suspend the second part 14 (e.g., a bridge deck) from the first part 12 (e.g., a pylon), or to stabilize a tall structure forming the first part 12 from the ground or some lower structure forming the second part 14.

The structural cable 10 comprises a bundle of tendons 22 disposed parallel to each other (FIG. 2) and contained in a collective sheath 20. For example, the bundled tendons may be steel strands each protected by a substance such as grease or wax and individually contained in a respective plastic sleeve.

The collective sheath 20 forms a protective cover for the bundle of tendons 22. It is in the form of a duct which internally defines a cavity running along the length of the cable 10 and within which the bundle of tendons 22 is arranged. The cross-section of the sheath 20 is typically circular. Other shapes, e.g. polygonal, elliptical, etc., are possible.

The cable 10 may have a length of up to several hundred meters. The bundle may include a few tens of tendons 22.

The sheath is typically made of plastic material such as high-density polyethylene (HDPE).

In most cases, the sheath 20 is formed by connecting a plurality of segments one after the other. For connecting two adjacent segments to each other, a known technique is mirror welding. It consists in locally heating and fusing the plastic material of the sheath at the ends of two adjacent segments and bringing those two ends together for welding the two segments. Another possibility is to have a telescoping interface between two adjacent sheath segments.

Each segment may be formed by assembling two or more shells together. In such a case, the sheath 20 can be installed on the bundle of tendons 22 after the tendons have been mounted and anchored to the structure.

Alternatively, each segment (or the whole sheath 20 if it is made of one piece of plastic material) is provided as an integral duct section. There are different possible mounting techniques for such a sheath 20.

In one technique, the plastic sheath 20 is laid on the ground, or bridge deck and, after threading the tendons 22 therein, the upper end of the cable thus assembled is hoisted to be connected to the upper anchoring device 16 at the first part 12, and the lower end is connected to the lower anchoring device 18 at the second part 14.

In another technique, the sheath 20 is first mounted along the oblique path of the cable 10, and the tendons 22 are subsequently threaded, one after the other or all together, into the sheath for connection to the anchoring devices 16, 18.

In yet another technique, the tendons 22 are first connected to the upper anchoring device 16 at the first part 12 and the sheath segments are pushed up one after the other from the lower end of the cable to form the sheath 20 before connecting the first (supporting) tendons 22 to the lower anchoring device 18.

The outer surface of the sheath 20 is exposed to the environment. When the weather is cold and humid, ice, snow or frost (hereafter referred to collectively as 'frozen water') may accumulate on the sheath. In the high parts of the cable, at least, it is preferable to take measures to minimize the risk that chunks of accumulated frozen water fall, in order to avoid damages or injuries.

To this effect, one or more of the higher segments, or all the segments, of the sheath 20 have a roughness texture on their outer surface. The roughness texture enhances the adherence of the frozen water to the sheath 20. The adherence promotes retention of the accumulated ice on the surface of the sheath, and allows that a substantial part of the accumulated ice melts before pieces of ice start to fall.

The roughness texture may take different forms. For example, it may be provided by corrugations or striations 30 as shown in FIGS. 2-5. The direction and/or size of such corrugations or striations can be regular, as shown, or randomly distributed.

Alternatively, the roughness texture may be provided by asperities or spikes (not shown) of various dimensions formed on the outer surface of the sheath.

Figure 2:
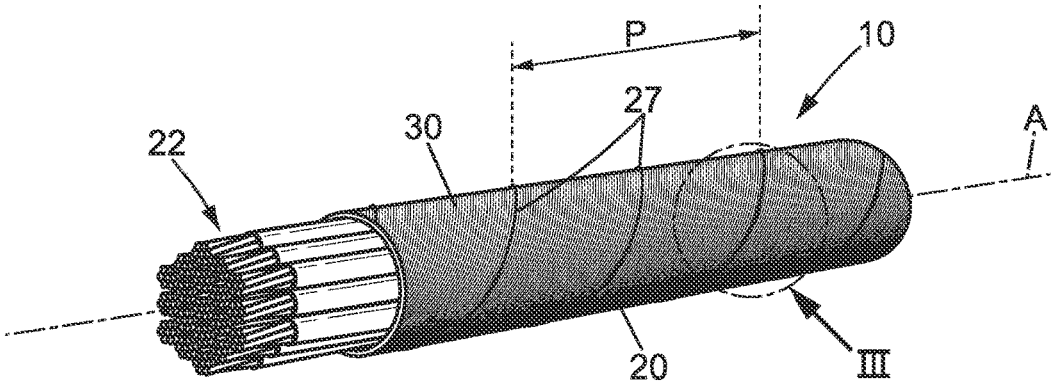
FIG. 2 is a perspective view showing schematically the structure of an example of stay cable.
Figure 3:
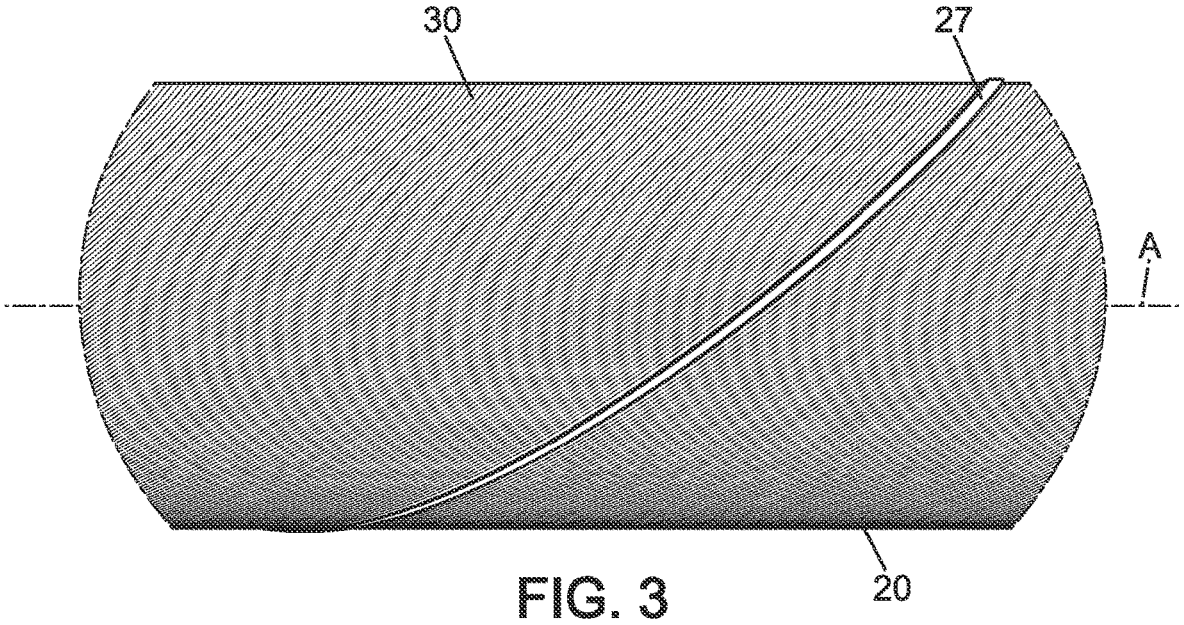
FIG. 3 is a side view of part of the sheath of the stay cable shown in FIG. 2, corresponding to the detail III indicated on FIG. 2.

A possible configuration of corrugations providing the roughness texture of the sheath surface is illustrated in FIGS. 2-3. In this example, the corrugations are in the form of parallel striations 30 which run parallel to each other along helical curves around and along the sheath.

The sheath 20 shown in FIGS. 2 and 3 also has a pair of parallel helical ribs that form protrusions 27 configured to increase the resistance of the sheath 20 to the combined effects of rain and wind. The protrusions 27 may be conventionally formed by affixing two HDPE beads to the outer surface of the sheath 20. Typically, the height of the protrusions 27 (perpendicular to the outer surface of the sheath 20) is in a range of 1 to 3 mm, and their width (parallel to the outer surface of the sheath 20) is in a range of 2 to 5 mm. The pitch P of the helical ribs may be between 30 and 60 cm (that is 3 to 6 times the outer diameter of the sheath). In FIG. 2, the spacing between the two ribs along the axis A of the sheath 20 is half of the pitch of the helical ribs.

In the example shown in FIGS. 2 and 3, the striations 30 follow helical curves about the axis A of the sheath 20, which are parallel to the helical ribs forming the protrusions 27, with the same pitch P.

However, the characteristic dimensions of the striations 30 (or other geometric elements of which the roughness texture is made) are at least 3 to 5 times smaller than those of the protrusions 27. In an embodiment, the geometric elements of the roughness texture 30 have dimensions in a range of 0.1 mm to 2 mm perpendicular to the outer surface of the sheath 20. In addition, they may have dimensions in a range of 0.1 mm to 5 mm parallel to the outer surface of the sheath 20. Most preferred dimensions parallel to the outer surface are in a range of 0.1 mm to 3 mm.

Thus, the striations provide the outer surface of the sheath 20 with the roughness texture between the protrusions 27. Such roughness texture is appropriate to increase the retention of ice on the surface of the sheath, so that the accumulated ice has time to melt to a large extent before the ice loses adherence and starts to fall underneath the structural cable 10. This reduces the risk of falling ice chunks of a substantial weight, e.g. more than 0.2 kg.

In the example shown, the roughness texture 30 covers the whole surface of the sheath 20 between the protrusions 27. It is generally enough if the roughness texture 30 covers a substantial portion of the outer surface of the sheath 20, namely more than 50%.

The striations 30 can be formed directly when manufacturing the duct-shaped sheath 10, or subsequently by using a suitable abrasion or machining process. This is preferably performed prior to affixing the beads forming the protrusions 27, if such protrusions 27 are used.

Figure 4:
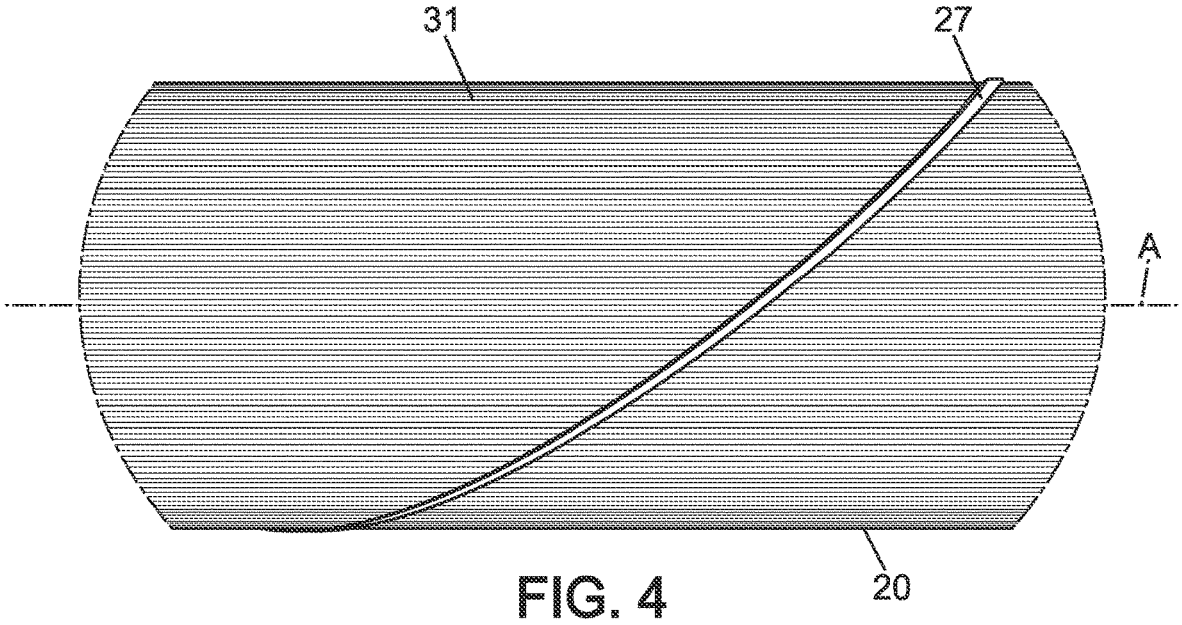
FIGS. 4 and 5 are side views showing alternative configurations of striations formed on sheath segments.
Figure 5:
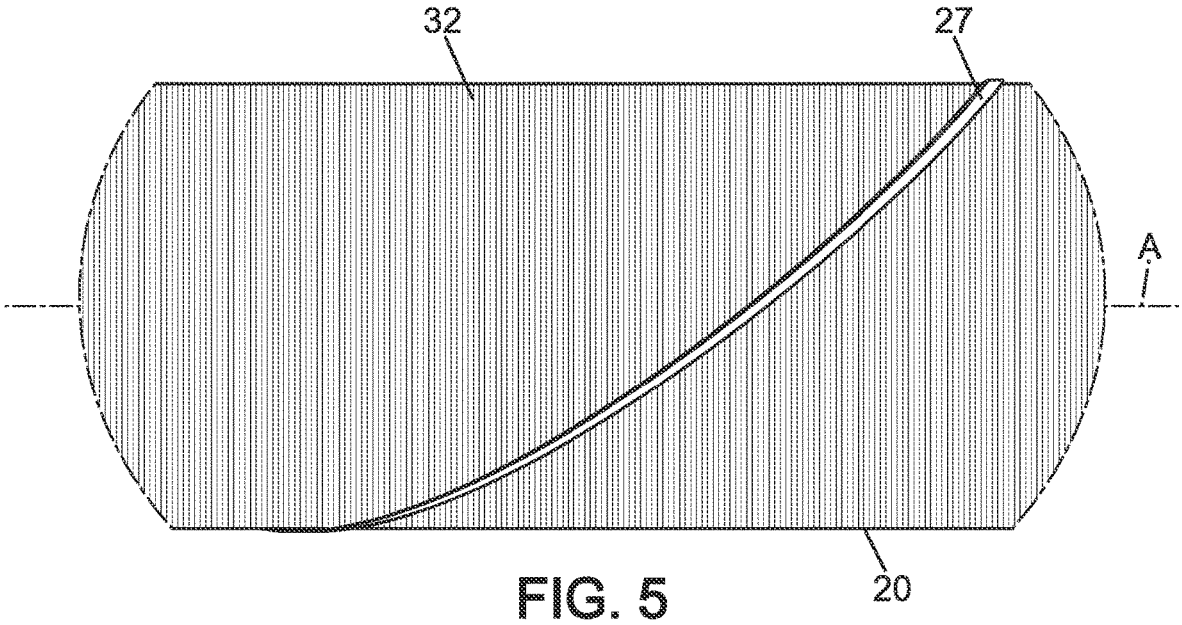

It is noted that the roughness texture 30 can have various shapes and configurations other than those shown in FIGS. 2 and 3. FIGS. 4 and 5 show examples where the roughness texture 31, 32 is again made of geometric elements in the form of striations. In the case of FIG. 4, the striations 31 extend parallel to the direction A of the sheath 20. In the case of FIG. 5, the striations 32 extend perpendicular to the direction A of the sheath 20.

Many other configurations are possible. For example, the striations can be in different directions on the surface of the sheath 20. Striations are not the only way of providing a suitable roughness texture. It is also possible that corrugations, asperities or spikes be formed randomly on the surface of the sheath.

Figure 6:
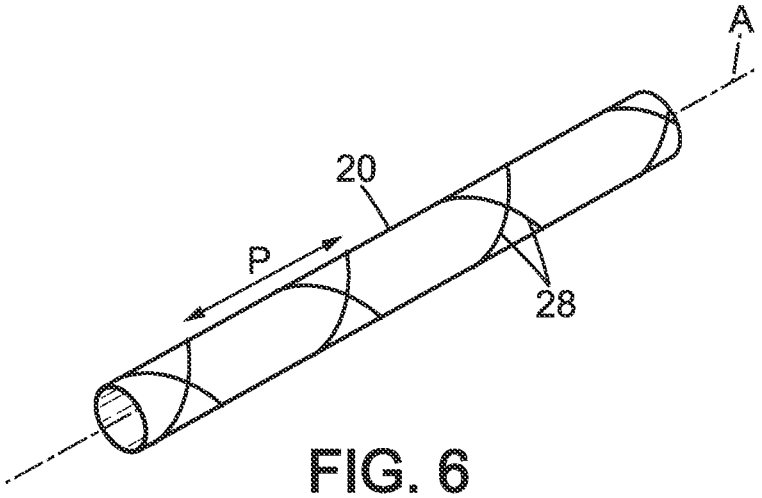
FIGS. 6 and 7 are perspective views of other embodiments of sheath segments.
Figure 7:
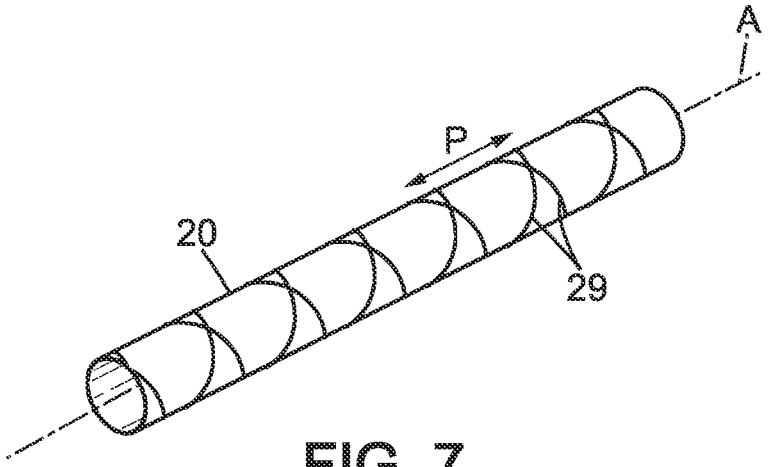

FIGS. 6 and 7 show alternative examples of helical ribs forming protrusions 28, 29 on the outer surface of sheath segments 20 to avoid rain/wind-induced vibrations.

In FIGS. 6 and 7, the roughness texture between the ribs is not shown in order to improve legibility of the drawing. In those examples, there are, again, two helical ribs forming the protrusions 28, 29 along and around the sheath 20. However, the helical paths of the two ribs have opposite directions, so that they cross each other. This is useful to prevent layers of ice from turning around the sheath 20 when the ice starts to melt. Therefore, it further improves retention of the accumulated ice on the exterior of the sheath.

In the case of FIG. 6, the pitch P of each helical rib is, for example, of 30 cm. In the case of FIG. 7, the pitch P of each helical rib is smaller, for example of 15 cm.

It will be appreciated that the embodiments described above are illustrative of the invention disclosed herein and that various modifications can be made without departing from the scope as defined in the appended claims.

The invention claimed is:

1. A sheath for a structural cable of a construction work, the sheath having an outer surface to be exposed to an environment of the construction work, wherein the outer surface of the sheath has a roughness texture to promote retention of frozen water, and wherein, in at least an upper part of the length of the sheath, the roughness texture covers more than half of the outer surface of the sheath, wherein the sheath comprises at least two helical ribs forming protrusions and extending along respective helical paths in opposite directions along the outer surface of the sheath, the roughness texture being located between the protrusions.

2. The sheath as claimed in claim 1, wherein the roughness texture are arranged such that the outer surface of the sheath has no smooth region in said upper part of the length of the sheath.

3. The sheath as claimed in claim 1, wherein the roughness texture comprises elements having dimensions in a range of 0.1 mm to 2 mm perpendicular to the outer surface of the sheath.

4. The sheath as claimed in claim 1, wherein the roughness texture comprises elements having dimensions in a range of 0.1 mm to 5 mm, parallel to the outer surface of the sheath.

5. The sheath as claimed in claim 1, wherein the roughness texture is in the form of striations.

6. The sheath as claimed in claim 5, wherein the striations-extend perpendicular to the direction of the sheath.

7. The sheath as claimed in claim 5, wherein the striations-extend helically around and along the sheath.

8. The sheath as claimed in claim 5, wherein the striations extend parallel to the sheath.

9. A sheath segment for forming a sheath for a structural cable of a construction work when assembled with at least one other segment, the sheath segment having an outer surface to be exposed to an environment of the construction work and provided with a roughness texture to promote retention of frozen water, wherein the roughness texture covers more than half of the outer surface of the sheath segment, the sheath segment comprising at least two helical ribs forming protrusions and extending along respective helical paths in opposite directions along the outer surface of the sheath segment, the roughness texture being located between the protrusions.

10. The sheath segment as claimed in claim 9, wherein the roughness texture is arranged such that the outer surface has no smooth region.

11. The sheath segment as claimed in claim 9, wherein the roughness texture comprises elements having dimensions in a range of 0.1 mm to 2 mm perpendicular to the outer surface, and dimensions in a range of 0.1 mm to 5 mm parallel to the outer surface.

* * * * *